United States Patent [19]

Deutsch

[11] 4,082,028

[45] Apr. 4, 1978

[54] SLIDING OVERTONE GENERATION IN A COMPUTOR ORGAN

[75] Inventor: Ralph Deutsch, Sherman Oaks, Calif.

[73] Assignee: Nippon Gakki Seizo Kabushiki Kaisha, Hamamatsu, Japan

[21] Appl. No.: 677,705

[22] Filed: Apr. 16, 1976

[51] Int. Cl.[2] ..... G10H 1/02; G10H 5/00

[52] U.S. Cl. ..... 84/1.24

[58] Field of Search ..... 84/1.01, 1.24, 1.25, 84/DIG. 4, DIG. 5

[56] References Cited

U.S. PATENT DOCUMENTS 3,929,053 12/1975 Deutsch ..... 84/1.24

*Primary Examiner*—Stanley J. Witkowski

*Attorney, Agent, or Firm*—Spensley, Horn & Lubitz

[57] ABSTRACT

Sliding overtone generation is implemented in a computor organ of the type disclosed in U.S. Pat. No. 3,809,786. In such an instrument, the sampled amplitudes of a musical waveshape are computed in real time by individually calculating the amplitude contributions of the Fourier components constituting the waveshape. In accordance with the present invention, one or more of these Fourier components is evaluated at a frequency which varies with time. The resultant overtone "slides" up or down in frequency between preselected limits at a controllable rate of "slide speed". Unusual tonal effects are achieved.

20 Claims, 7 Drawing Figures

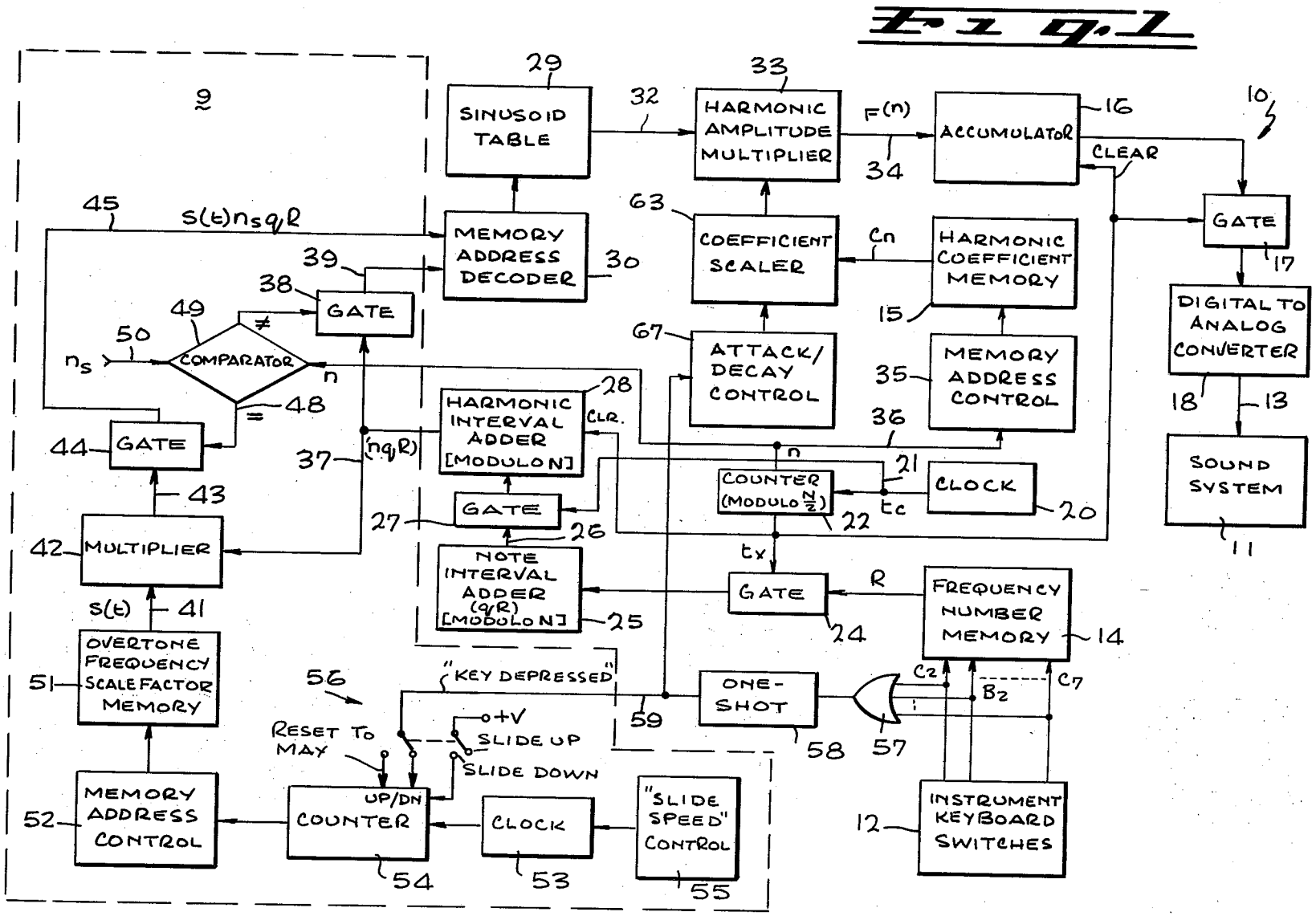
FIG. 1
GATE
DIGITAL TO ANALOG CONVERTER
SOUND SYSTEM
CLEAR
ACCUMULATOR
HARMONIC COEFFICIENT MEMORY
MEMORY ADDRESS CONTROL
CLOCK
FREQUENCY NUMBER MEMORY
INSTRUMENT KEYBOARD SWITCHES
HARMONIC AMPLITUDE MULTIPLIER
COEFFICIENT SCALER
ATTACK/DECAY CONTROL
COUNTER (MODULO N/2)
GATE
ONE-SHOT
"SLIDE SPEED" CONTROL
SINUSOID TABLE
MEMORY ADDRESS DECODER
HARMONIC INTERVAL ADDER [MODULO N]
GATE
NOTE INTERVAL ADDER (q/R) [MODULO N]
"KEY DEPRESSED"
+V
SLIDE UP
SLIDE DOWN
CLOCK
UP/DN COUNTER
RESET TO MAX
GATE
COMPARATOR
GATE
MULTIPLIER
OVERTONE FREQUENCY SCALE FACTOR MEMORY
MEMORY ADDRESS CONTROL

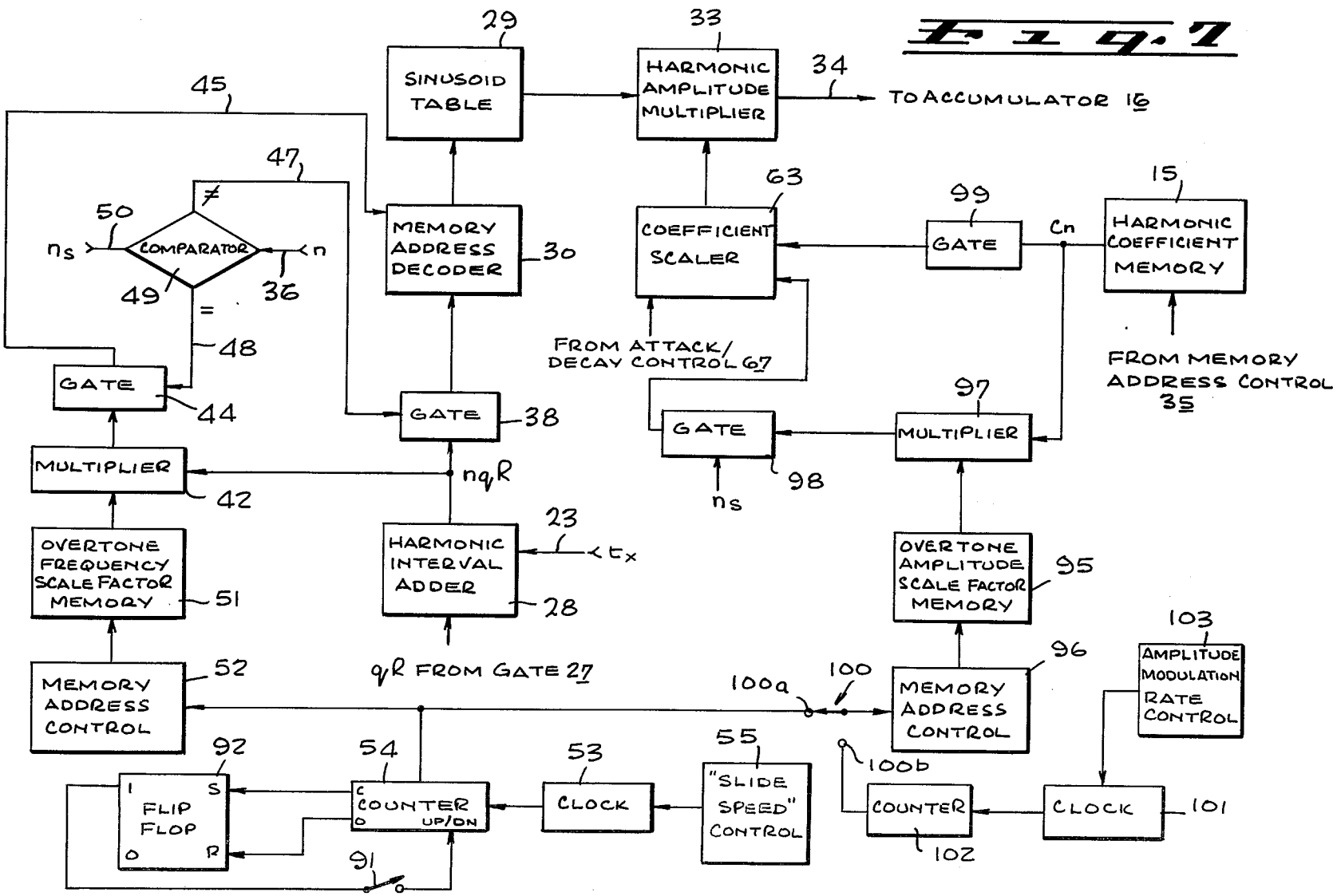
FIG. 7
TO ACCUMULATOR 16
HARMONIC COEFFICIENT MEMORY
15
FROM MEMORY ADDRESS CONTROL 35
AMPLITUDE MODULATION RATE CONTROL
103
CLOCK
101
Cn
GATE
99
MULTIPLIER
97
OVERTONE AMPLITUDE SCALE FACTOR MEMORY
95
MEMORY ADDRESS CONTROL
96
COUNTER
102
100b
100
100a
34
HARMONIC AMPLITUDE MULTIPLIER
33
COEFFICIENT SCALER
63
FROM ATTACK/DECAY CONTROL 67
GATE
98
ns
"SLIDE SPEED" CONTROL
55
CLOCK
53
SINUSOID TABLE
29
MEMORY ADDRESS DECODER
30
GATE
38
nqR
HARMONIC INTERVAL ADDER
28
23
tx
qR FROM GATE 27
COUNTER UP/DN
54
91
47
45
COMPARATOR
36
n
48
49
50
ns
GATE
44
MULTIPLIER
42
OVERTONE FREQUENCY SCALE FACTOR MEMORY
51
MEMORY ADDRESS CONTROL
52
FLIP FLOP
92

SLIDING OVERTONE GENERATION IN A COMPUTOR ORGAN

BACKGROUND OF THE INVENTION

1. Field of the Invention

The present invention relates to the generation in a computor organ of musical sounds having "sliding" overtones that change in frequency as a function of time.

2. Description of the Prior Art

The history of electronic musical instruments has been relatively short when compared to the long periods during which "conventional" acoustic-type orchestral instruments have undergone their evolution to their present state. Electronic musical instrument development has understandably followed the obvious path of attempting to imitate or replicate the tone of the acoustic type of orchestral musical instruments. Thus, intensive efforts have been made to build electronic counterparts of wind-blown organ pipes. These electronic instruments have been relatively successful because of some rather simple tonal characteristics of a wind-blown pipe. By adding various random noises and by careful control of the attack and release of a tone, very acceptable electronic organs have been designed. Fairly recently attempts have been made to obtain electronic instruments which imitate various orchestral-type musical instruments. It has been recognized that such electronic instruments must be capable of generating a wide variety of time variant tonal modulations instead of the simple on-off modulation of an organ-like tone. For lack of a better term, this new class of time variant modulation of tonal parameters has been given the generic name of "synthesizer" or "tone synthesizer".

An interesting by-product of the work on tone synthesizers is that there exists a wide variety of tonal effects which are definitely not imitative of conventional orchestral musical instruments. These tone effects have captured the fertile imagination of popular music musicians and have been used so effectively and frequently that these tonal effects now have found acceptance in orchestral groups.

An object of the present invention is to provide means for generating an entirely new family of synthesizer tones. These tones are all characterized by one or more overtones which may not be harmonically related to the fundamental and whose separation from the fundamental is time variant. Another object is to provide means for implementing such "sliding overtone" generation in an electronic musical instrument such as the computor organ disclosed in U.S. Pat. No. 3,809,786.

SUMMARY OF THE INVENTION

These and other objectives are achieved by providing sliding overtone generation systems for a computor organ of the type described in the above mentioned U.S. Pat. No. 3,809,786. In such an instrument, musical notes are generated by computing the amplitudes at successive sample points of a musical waveshape and converting the amplitudes to musical sounds as the computations are carried out in real time. For each sample point $q$R, the constituent harmonic amplitudes $F^{(n)}$ are calculated individually, then combined to obtain the waveshape amplitude $X_o(q\mathrm{R})$. The computations are carried out in accordance with the following discrete Fourier representation of a sampled periodic complex waveshape:

$$X_o(qR) = \sum_{n=1}^{W} F^{(n)} = \sum_{n=1}^{W} C_n \sin \frac{\pi}{W} nqR \text{ for } q = 1,2,3, \ldots \quad \text{(Eq.1)}$$

wherein R is a frequency number which establishes the fundamental frequency of the generated note, $n=1,2,3 \ldots$, W designates the harmonic or Fourier component being evaluated, and $C_n$ is a harmonic coefficient establishing the relative amplitude of the $n^{th}$ harmonic. Preferably $W=N/2$, where $N$ is the number of sample points per period for the note of highest fundamental frequency to be generated by the instrument. Quite satisfactory tonal quality is provided in a system wherein N=32, and for which W=16 Fourier components are included in the waveform synthesis.

In a computor organ which implements equation 1, each of the harmonic components $F^{(n)}$ has a frequency which is an integral multiple of the nominal fundamental frequency, and which frequency does not change with time. In accordance with the present invention, one or more of the Fourier components is made to have a frequency that is time variant, so as to produce a sliding overtone effect. To this end, the sample point amplitudes are computed in accordance with the following equation:

$$X_o(qR) = \sum_{n=1}^{(n_s-1)} F^{(n)} + F^{(n_s)} + \sum_{n=(n_s+1)}^{W} F^{(n)} \quad \text{(Eq.2)}$$

wherein:

$$F^{(n)} = C_n \sin \frac{\pi}{W} nqR \quad \text{(Eq.3)}$$

for all values of $n$ except $n=n_s$ and wherein:

$$F^{(n\text{-}s)} = C_{n_s} \sin \frac{\pi}{W} s(t)\, n_s qR \quad \text{(Eq.4)}$$

where $s(t)$ is a time variant overtone frequency scale factor, and $n_s$ corresponds to the nominal order of the Fourier component which is to "slide". For the specific case when $s(t)=1$, equation 2 becomes equal to equation 1 and a tone is generated in which the harmonic spectrum is non-time variant and in which the $(n_s)^{th}$ Fourier component is not shifted in frequency from its nominal value.

To implement equations 2–4 in a computor organ, a set of overtone frequency scale factors $s(t)$ advantageously are stored in a read only memory. Successive scale factors are accessed from the memory at a controllable clock rate that establishes the "slide speed" or rate at which the $(n_s)^{th}$ overtone is shifted in frequency. Each time the $(n_s)^{th}$ overtone amplitude component is calculated, the value $(nq\mathrm{R})=(n_s q\mathrm{R})$ supplied from the harmonic interval adder of the computor organ is multiplied by the scale factor $s(t)$ currently accessed from the overtone frequency scale factor memory. The product $s(t)n_s q\mathrm{R}$ then is supplied back to the computor organ to complete the evaluation of the Fourier component $F^{(n_s)}$ in accordance with equation 4 above. The resultant synthesized musical sound exhibits a "sliding overtone" effect.

BRIEF DESCRIPTION OF THE DRAWINGS

A detailed description of the invention will be made with reference to the accompanying drawings, wherein like numerals designate corresponding parts in the several figures.

FIG. 1 is an electrical block diagram of a computor organ incorporating the inventive system for sliding overtone generation.

FIG. 7 is a block diagram of still another embodiment of the invention wherein the amplitude of the sliding overtone also is time variant.

DESCRIPTION OF THE PREFERRED EMBODIMENTS

Figure 3:
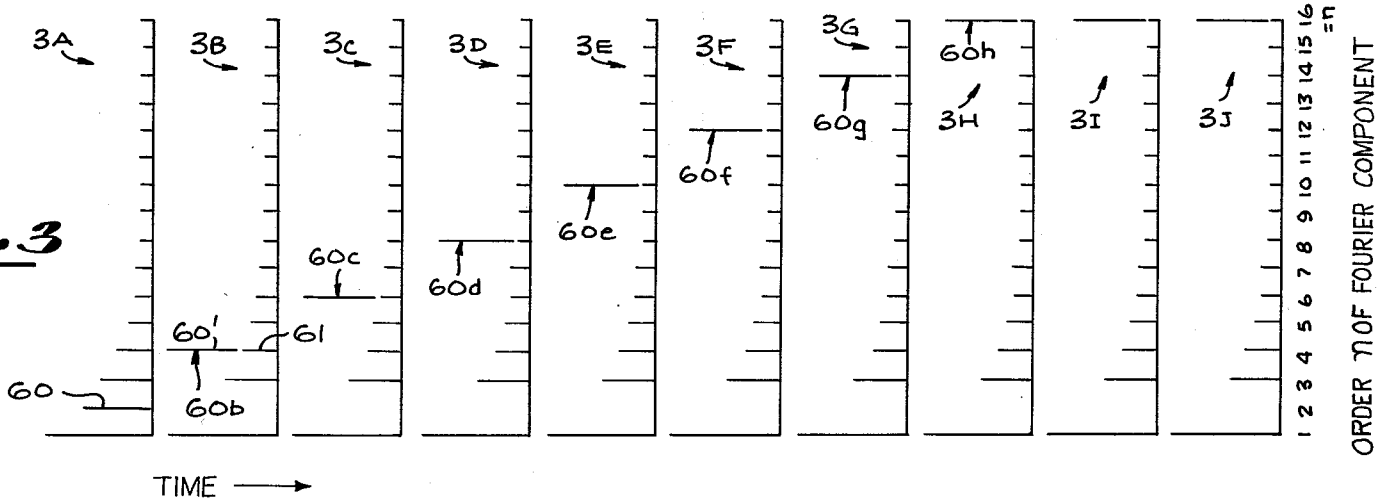
FIG. 3 is a set of spectra illustrating the relative amplitudes of the constituent Fourier components evaluated by the system of FIG. 1 to produce the musical waveshape of FIG. 2.

The following detailed description is of the best presently contemplated modes of carrying out the invention. This description is not to be taken in a limiting sense, but is made merely for the purpose of illustrating the general principles of the invention since the scope of the invention best is defined by the appended claims.

Structural and operational characteristics attributed to forms of the invention first described shall also be attributed to forms later described, unless such characteristics are obviously inapplicable or unless specific exception is made.

In the embodiment of FIG. 1, the sliding overtone generation circuitry 9 operates in conjunction with a computor organ 10 to produce via a sound system 11 a musical tone characterized by having one overtone the frequency of which is time variant. For example, the system of FIG. 1 can generate the typical swept-overtone musical waveshape of FIG. 2. In this waveshape, the sliding overtone initially is produced at the frequency of the second harmonic (spectrum 3A of FIG. 3) and progressively increases in frequency (spectra 3B through 3G, FIG. 3) until it coincides with the sixteenth harmonic and thereafter remains at the same frequency (spectra 3H through 3J).

Except for the addition of the sliding overtone generation circuitry 9, the computor organ 10 of FIG. 1 operates in the same manner as that disclosed in FIG. 1 of the inventor's U.S. Pat. No. 3,809,786 entitled COMPUTER ORGAN. The various computor organ 10 components in FIG. 1 herein have been designated by numerals identical to those used in FIG. 1 (and, with respect to the coefficient scaler 63 and attack/decay control 67, as used in FIG. 4) of that patent.

Operation of the computor organ 10 will be briefly summarized. Each time one of the keyboard switches 12 is depressed, a waveshape corresponding to the desired tone is generated and supplied via a line 13 to the sound system 11. Waveshape synthesis is accomplished by calculating the discrete Fourier components associated with amplitudes at successive sample points of the waveshape. The components are algebraically summed in an accumulator 16 which, at the end of each computation time interval $t_x$ contains the amplitude at the current sample point. This amplitude is provided via a gate 17, enabled by the $t_x$ signal on a line 23, to a digital-to-analog converter 18 which supplies to the sound system 11 a voltage corresponding to the waveshape amplitude just computed. Computation of the amplitude at the next sample point subsequently is initiated, so that the analog voltage supplied via the line 13 from the converter 18 comprises a musical waveshape generated in real time.

The period of the computed waveshape, and hence the fundamental frequency of the generated note, is established by a frequency number R selected by the keyboard switches 12. A set of such frequency numbers corresponding to the notes of the instrument is stored in a frequency number memory 14. The waveshape amplitude $X_o(qR)$ at each sample point is computed in accordance with equation 1 if the circuitry 9 is not employed, and in accordance with equations 2 through 4 when the sliding overtone generation circuitry 9 is utilized. The computor organ 10 of FIG. 1 implements these equations by computing the amplitude value $X_o(qR)$ for each sample point during a time interval $t_x$ established by a clock 20 and a counter 22 of modulo (N/2). Each Fourier component of order $n=1,2,\ldots, W=N/2$ is individually calculated at a successive time interval $t_c$ established by the clock pulses supplied on a line 21 from the clock 20. The contents of the counter 22, which advantageously is a binary counter of modulo 16, represents the value $n$, which is present in binary form on a line 36. Each time that the counter 22 reaches a count of sixteen and resets, a computation time interval $t_x$ pulse is produced on the line 23. At this time, all of the constituent Fourier component amplitudes have been summed in the accumulator 16 so that the contents thereof represents the amplitude at the current sample point ($q$R). Accordingly, this signal $t_x$ on the line 23 enables the gate 17 to provide this amplitude value to the converter 18. The $t_x$ pulse also clears the accumulator 16 so that it can begin accumulation of the next sample point amplitude.

At the same time, the $t_x$ pulse enables a gate 24 to provide the frequency number R to a note interval adder 25 (advantageously of modulo N) where it is added to the previous contents. Thus, the note interval adder 25 provides via the line 26 the value ($q$R) identifying the sample point at which the waveshape amplitude currently is being computed. At each Fourier component calculation interval $t_c$, the pulse on the line 21 enables a gate 27 to provide this value ($q$R) to a harmonic interval adder 28 (also of modulo N), the contents of which thus represents the quantity ($nq$R). The adder 28 is cleared at the end of each waveshape amplitude computation cycle by the $t_x$ signal on the line 23. To implement equation 1 above, the value ($nq$R) from the harmonic interval adder 28 would be supplied directly to the memory address decoder 30. However, in accordance with the present invention wherein equations 2–4 are implemented to provide a sliding overtone effect, the value ($nq$R) is supplied from the adder 28 via a line 37 to a gate 38. During calculation of all Fourier components which do not "slide" (i.e., which do not change in frequency as a function of time), the gate 37 is enabled so as to provide the value ($nq$R) via a line 39 to the memory address decoder 30. During evaluation of the sliding overtone (that is, for the $(n_s)^{th}$ Fourier component), the gate 38 is disabled and the quantity ($nq$R) is multiplied by an overtone frequency scale factor $s(t)$ supplied on a line 41 by a multiplier 42. The product $s(t)n_sq$R is supplied via a line 43, and enabled gate 44 and a line 45 to the memory address decoder 30.

The address decoder 30 accesses from a sinusoid table 29 the value sin $(\pi/W)nq$R corresponding to the argument $nq$R received via the line 39 when the gate 38 is enabled, or accesses the value sin $(\pi/W)s(t)n_sq$R corresponding to the argument $s(t)n_sq$R supplied on the line 45 when the gate 44 is enabled. The sinusoid table 29 may comprise a read only memory storing values of sin $(\pi/W)\phi$ for $0 \leqq \phi \leqq 2W$ at intervals of D, where D is called the resolution constant of the memory.

The corresponding value sin $(\pi/W)nq$R or sin $(\pi/W)s(t)n_sq$R is supplied via a line 32 to a harmonic amplitude multiplier 33 where it is multiplied by a scaled harmonic coefficient supplied from the coefficient scaler 63. The unscaled harmonic coefficients $C_n$ are provided from a harmonic coefficient memory 15 which stores a set of such coefficients that establish the relative amplitudes of the Fourier components included in the waveshape amplitude computation. Each such coefficient $C_n$ is accessed from the memory 15 by a memory address control 35 which receives the Fourier component order value $n$ from the line 36. An illustrative set of such harmonic coefficients $C_n$ is included in Table I below. During attack and delay, each coefficient $C_n$ is scaled by an appropriate amplitude envelope scale factor supplied from the attack/decay control 67 to the coefficient scaler 63. The product supplied on the line 34 by the multiplier 33 corresponds to the Fourier component amplitude $F^{(n)}$ for the $n^{th}$ order, or the corresponding value $F^{(n_s)}$ for the sliding overtone.

TABLE I

| Coefficient | Value Stored In Memory 15 (Relative Amplitude) | (Decibel Equivalent) |
|---|---|---|
| $C_1$ | 127 | 0 |
| $C_2$ | 55 | −6.9 |
| $C_3$ | 36 | −11 |
| $C_4$ | 25 | −13.9 |
| $C_5$ | 20 | −16.1 |
| $C_6$ | 17 | −17.9 |
| $C_7$ | 15 | −19.5 |
| $C_8$ | 13 | −20.8 |
| $C_9$ | 12 | −22.0 |
| $C_{10}$ | 10 | −23.0 |
| $C_{11}$ | 8 | −24.0 |
| $C_{12}$ | 7 | −24.9 |
| $C_{13}$ | 6 | −25.7 |
| $C_{14}$ | 6 | −26.4 |
| $C_{15}$ | 5 | −27.1 |
| $C_{16}$ | 5 | −27.7 |

Referring again to the sliding overtone generation circuitry 9 of FIG. 1, the gates 38 and 44 respectively are enabled by the unequal ($\neq$) and equal (=) outputs on the lines 47 and 48 from a comparator 49. The circuit 49 compares the order of the Fourier component currently being evaluated, as designated by the value $n$ present on the line 36, with the order $n_s$ of the component that is to "slide", as designated by a signal representing the value $n_s$ provided on a line 50. If $n \neq n_s$, a signal is provided on the line 47 which enables the gate 38. As a result, the corresponding value $F^{(n)}$ is evaluated and supplied via the line 34 to the accumulator 16. When $n = n_s$, a signal is provided on the line 48 to enable the gate 44. In that instance, the sliding overtone $F^{(n_s)}$ is evaluated and provided to the accumulator 16.

The overtone frequency scale factors $s(t)$ are completely arbitrary. Advantageously, a set of such scale factors $s(t)$ are stored in a read only memory 51 that is accessed by a memory address control 52. The rate at which consecutive scale factors are read from the memory 51 is controlled by a clock 53 and a counter 54. The frequency of the clock 53 may be adjusted by a control 55 which, since it affects the rate at which consecutive scale factors $s(t)$ are read from the memory 51, and hence the rate at which the overtone frequency changes, is designated a "slide speed" control. The clock 53 may comprise a voltage controlled oscillator, and the control 55 may be a circuit such as a potentiometer which supplies a controllable voltage to the VCO clock 53.

The memory 51 and address control 52 may be implemented using a commercially available integrated circuit field-programmable read only memory such as the Signetics type SIG 8223 or Texas Instrument type SN 5488A or SN 7488A ROM. These memories include address control circuitry which accept a binary coded address code that may be obtained directly from the counter 54. The counter 54 itself may be implemented using e.g., a Signetics type SIG 8281 integrated circuit counter.

By way of example, the overtone frequency scale factors $s(t)$ may be selected so that an overtone is swept only to consecutive harmonic frequencies. In this case, the memory 51 could store the scale factors $s(t) = 1, 1.5, 2, 2.5, \ldots, 7.5, 8$. In the example of FIG. 3, these frequency scale factors are applied to the second overtone ($n_s = 2$). If the counter 54 initially is reset to zero and is incremented by the timing pulses from the clock 53, the scale factors $s(t)$ will be accessed in the order just listed, so that the single sliding overtone will be swept upward in frequency. This occurs when a switch 56 (FIG. 1) is set to the "SLIDE UP" position shown. When the switch 56 is set to the "SLIDE DOWN" position, the counter 54 initially is reset to its maximum value, so that the frequency scale factor $s(t)$ of highest value is accessed first. The counter 54 is decremented by successive pulses from the clock 53 so that scale factors $s(t)$ of successively smaller value are accessed from the memory 51. As a result, the single overtone will start at a high frequency and be swept downward. In both instances, sliding of the overtone is initiated when any key is depressed. At this time, at least one input is provided to an OR-gate 57 which triggers a monostable multivibrator ("one-shot") 58. The resultant "key depressed" signal on a line 59 is supplied via the switch 56 to the appropriate reset input to the counter 54.

Figure 2:
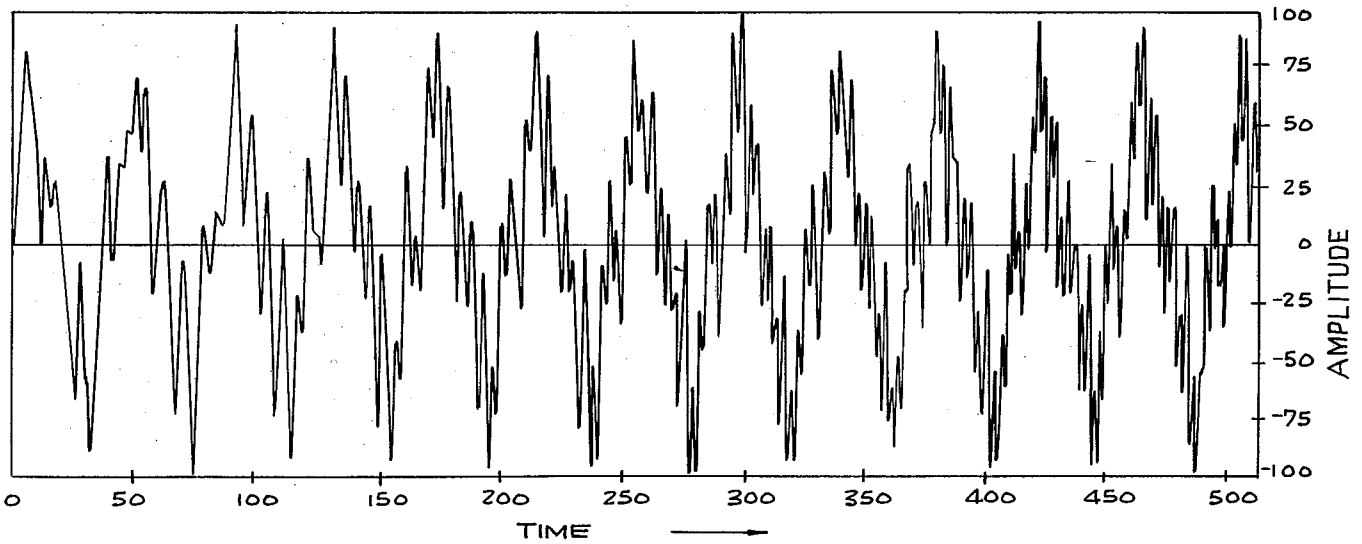
FIG. 2 is a graph representing a typical musical waveform generated with the system of FIG. 1 and having a single sliding overtone that increases in frequency as a function of time.

Operation of the sliding overtone generation circuitry 9 of FIG. 1 is illustrated by the spectra of FIG. 3 and the generated waveshape of FIG. 2. In this example, there is a single sliding overtone which initially is at the frequency of the second harmonic ($n = n_s = 2$). Using the illustrative scale factors $s(t)$ listed above, the sliding overtone will correspond in frequency to consecutively higher harmonics as each successive scale factor is accessed from the memory 51. The relative amplitudes of the various Fourier components indicated by the spectra of FIG. 3 correspond to those listed in TABLE I above.

With these parameters, the generated waveshape will have the appearance of FIG. 2, where time is indicated along the abcissa, and amplitude along the ordinate. The various spectra 3A through 3J are situated above the corresponding time intervals of the waveshape of FIG. 2. Thus, at the beginning of tone generation, when the value $s(t)=1$ is accessed from the memory 51, during calculation of the $(n=n_s)^{th}$ Fourier component the multiplier 42 will multiply the value $nq$R by one, so that this value $nq$R is supplied via the line 45 to the memory address decoder 30. This results in production of the corresponding Fourier component $F^{(n)}=F^{(n_s)}$ in the position of the second harmonic, as indicated by the component 60 in the spectrum 3A. At a later time, when the scale factor $s(t)=2$, the Fourier component $F^{(n_s)}$ will be calculated using the value $s(t)n_sq\mathrm{R}=(2)2q\mathrm{R}$. Accordingly, that component will have the same frequency as the $(n=4)^{th}$ Fourier component. As a result, the amplitude of the sliding overtone 60' (spectrum 3B) will be added to the amplitude contribution 61 of the $(n=4)^{th}$ Fourier component to provide a resultant fourth harmonic amplitude indicated by the overall height of the bar **60*b* in FIG. 3. At still later times, the sliding overtone will increase the amplitude of consecutively higher order harmonics, as indicated by the bars 60*c* through 60*g* in the spectra 3C through 3G. Eventually, the counter 54 will reach a value at which the highest magnitude frequency scale factor $s(t)$ is accessed from the memory 51. In the example, this will be $s(t)=8$. At this time, the sliding overtone will correspond in frequency to the sixteenth $(n=16)$ harmonic, as indicated by the bar 60*h* in the spectrum 3H. Thereafter, the same value $s(t)=8$ will continue to be accessed from the memory 51 so that the sliding overtone remains fixed at this sixteenth harmonic frequency, as indicated by the spectra 3I and 3J. The generated waveform of FIG. 2 thereafter will remain uniform. (Note that the spectra of FIG. 3 indicate the Fourier component contributions evaluated by the computer organ 10 at times when different values $s(t)$ are accessed from the memory 51. Since the resultant sliding overtone is changing frequency, the actual Fourier spectral content obtained by analysis of the generated wave shape of FIG. 2 will be different from the spectra of (FIG. 3**.)

Figure 4:
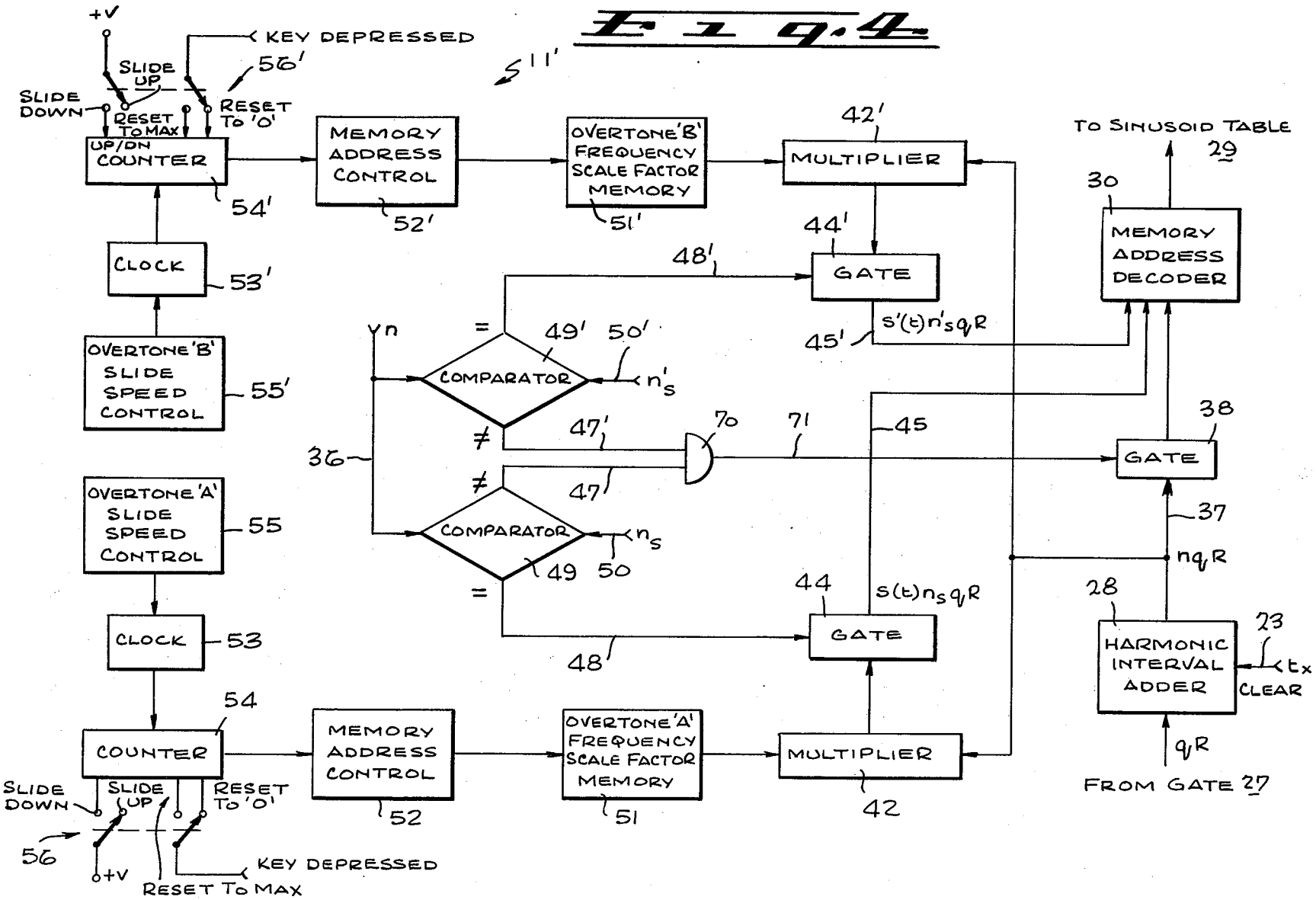
FIG. 4 is an electrical block diagram of an alternative sliding overtone generation system in which two overtones are separately varied in frequency.

Musical sounds having two sliding overtones are produced using the circuitry 11' of FIG. 4. The circuitry in the lower half of FIG. 4 is identical to that of FIG. 1, and produces a sliding overtone (overtone "A") during the calculation interval of order $n=n_s$. The second sliding overtone (overtone "B") is produced by identical circuitry shown in the upper portion of FIG. 4 and designated by primed numerals. The second sliding overtone "B" is produced during the calculation interval of order $n=n'_s$. The overtone "B" frequency scale factor memory 51' stores a set of scale factors $s'(t)$ which may be identical to the scale factors stored in the memory 51, or may be different. During the calculation interval $n=n'_s$, the comparator 49' will enable a gate 44' which supplies the value $s'(t)n'_sq\mathrm{R}$ via the line 45' to the memory address decoder 30.

During all calculation intervals other than those for order $n_s$ or $n'_s$, both comparators 49 and 49' will provide high signals along the respective lines 47 and 47', so that an AND-gate 70 will provide an enable signal via a line 71 to the gate 38. In this instance, the value $nq$R from the harmonic interval adder 28 is supplied directly to the memory address decoder 30. The corresponding $n^{th}$ order Fourier component of fixed frequency is produced.

Using the circuitry 11' of FIG. 4, the two sliding overtones can be controlled independently with respect to the range over which the frequency slides, the slide speed, and the direction of slide. For example, the scale factors stored in the memories 51 and 51' establish the frequency range. If $n'_s=3$, and the scale factors $s'(t)$ in the memory 51' range from 1 to 5, then the overtone "B" will range between the frequency of the third harmonic to the frequency of the fifteenth harmonic. The speed at which the overtone "B" slides is established by the control 55', and the setting of the switch 56' determines whether the slide is "up" or "down", that is, of increasing or decreasing frequency respectively.

Figure 5:
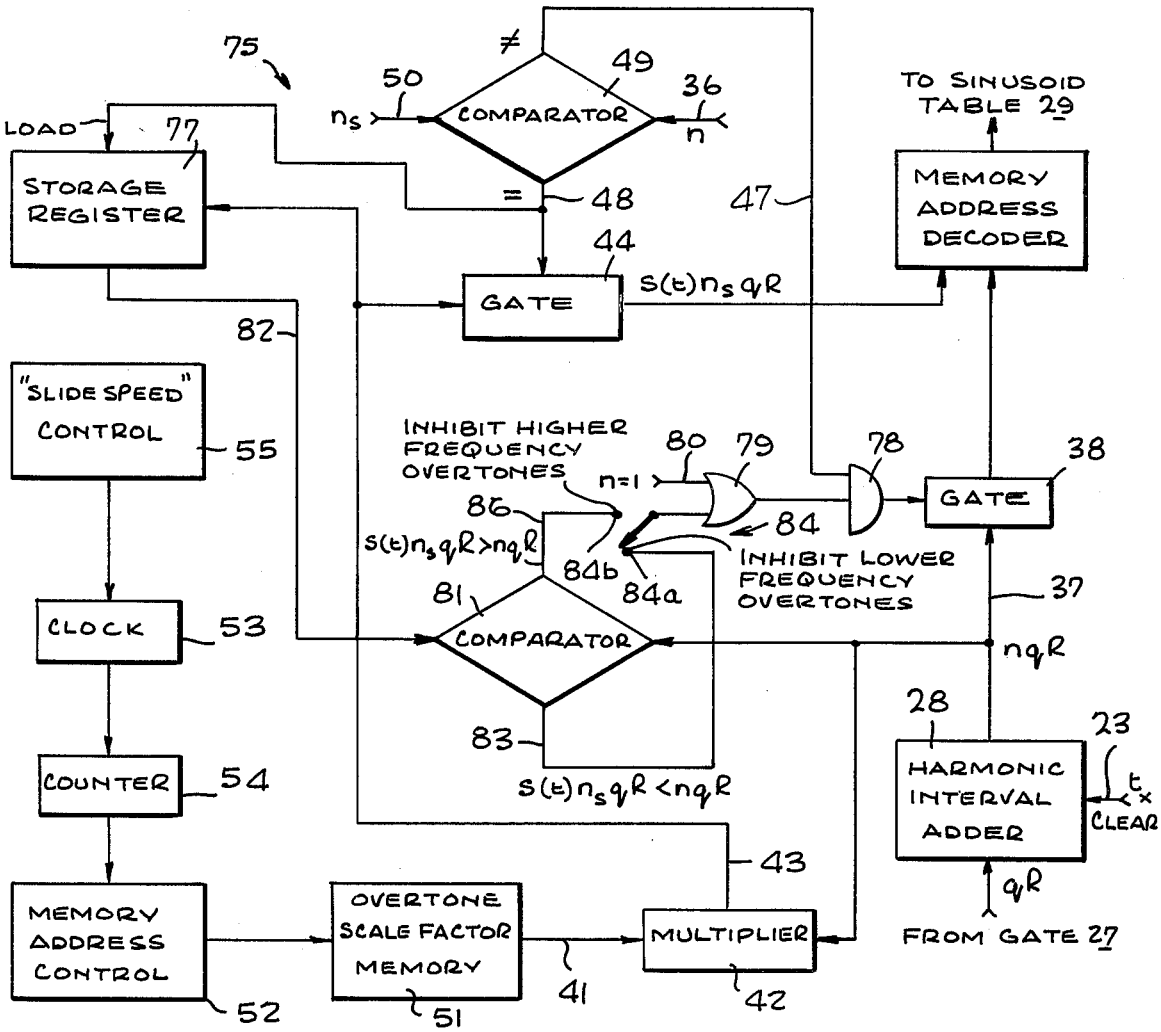
FIG. 5 is an electrical block diagram of yet another embodiment of the invention wherein a single overtone is frequency variant, and wherein other Fourier components of the generated tone are either inhibited or added as the frequency of the sliding overtone crosses the frequencies of those other Fourier components.
Figure 6:
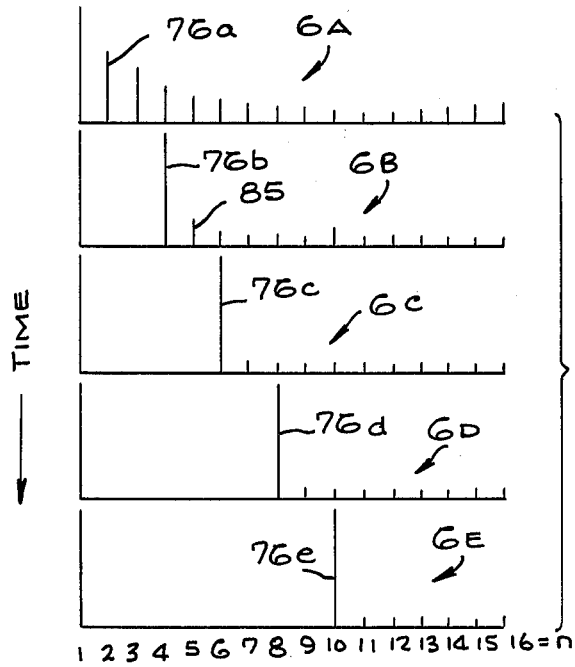
FIG. 6 is a set of harmonic spectra illustrating operation of the embodiment of FIG. 5 wherein harmonics of frequency lower than the sliding overtone are inhibited.

The embodiment of FIG. 5 incorporates circuitry 75 for inhibiting incorporation of those fixed-frequency harmonics which are either lower or higher in frequency than the sliding overtone. This is illustrated by the spectra 6A through 6E of FIG. 6, wherein the bars **76*a* through 76*e* represent the sliding overtone at successive times. The fundamental $(n=1)$ always is produced, however, as the sliding overtone increases in frequency, the other harmonics of lower frequency are inhibited, i.e., excluded from the waveshape amplitude computation. Thus, in spectrum 6B, the sliding overtone 76*b* is at the frequency of the fourth harmonic, and the third harmonic is inhibited. At the later time illustrated by the spectrum 6E, the sliding overtone 76*e*** is at the frequency of the $(n=10)^{th}$ harmonic, and all other harmonics of order $n=3$ through $n=9$ are inhibited.

To implement this harmonic inhibit operation, the circuitry 75 (FIG. 5) includes a storage register 77 that is loaded with the current value $s(t)n_sq\mathrm{R}$ each time that the sliding overtone amplitude contribution is evaluated. To this end, the $(n=n_s)$ output signal on the line 48 from the comparator 49 is used both to enable the gate 44 (as described above in connection with FIG. 1) and to cause the storage register 77 to be loaded with the value $s(t)n_sq\mathrm{R}$ present on the line 43 from the multiplier 42.

When any non-sliding Fourier component is to be evaluated (i.e., when $n\neq n_s$), a determination is made as to whether this Fourier component is to be included in the waveshape amplitude computation. To this end, the comparator not-equal output on the line 47 enables an AND-gate 78 which receives its other input from an OR-gate 79. If the fundamental $(n=1)$ is being evaluated, a high signal will be provided via a line 80 to the OR-gate 79, so that the AND-gate 80 will provide an output that enables the gate 38. As a result, the value $nq\mathrm{R}=1q\mathrm{R}$ will be provided from the line 37 to the memory address 30. As a result, the fundamental will be produced.

For each Fourier component other than the fundamental, a comparison is made as to whether the current frequency of the sliding overtone is higher or lower than the particular Fourier component. This is accomplished by a comparator 81 which receives as a first input, supplied via a line 82 from the storage register 77, the most recent value $s(t)n_sq\mathrm{R}$ that is indicative of the current frequency of the sliding overtone. As a second input, the comparator 81 receives from the line 37 the value $nq$R which is indicative of the frequency of the Fourier component currently being evaluated. If that Fourier component has a frequency higher than that of the sliding overtone, the comparator 81 will provide a high output on a line 83 which is supplied via the contact **84*a* of a switch 84 to the OR-gate 79. As a result, the gate 38 will be enabled, the current value $nq$R will be supplied to the memory address decoder 30, and the Fourier component of higher frequency will be included in the waveshape computation. For example, if the sliding overtone is at the position 76*b* shown in the spectrum 6B, and the Fourier component of order $n=5$ is being produced, the gate 38 will be enabled and the corresponding fifth harmonic 85 (FIG. 6) will be included in the generated musical waveshape. On the other hand, if the frequency of the Fourier component is lower than that of the sliding harmonic, the signal on the line 83 will be low, and the comparator 81 will provide a high signal on the line 86. In this instance, the gate 38** is not enabled, and this lower-frequency overtone is inhibited.

The circuitry 75 of FIG. 5 also can be used to produce spectra in which all Fourier components of frequency higher than the sliding overtone are inhibited, but overtones of lower frequency are included in the produced tone. Such a musical sound would be illustrated by spectra that are "opposite", those shown in FIG. 6. This is accomplished merely by setting the switch 84 to the position 84*b*. In this case, each time the value *nq*R corresponds to a Fourier component of frequency lower than the sliding overtone, the high signal on the line 86 will be provided via the switch 84 to the OR-gate 79 so that the gate 38 is enabled. This lower-frequency overtone thus is included in the generated waveshape. Conversely, if the Fourier component is of frequency higher than the sliding overtone, the high signal on the line 83 will not reach the OR-gate 79, and hence the corresponding higher frequency overtone will be inhibited.

The embodiment of FIG. 7 illustrates two other sliding overtone effects. These are continuous up-and-down frequency variation of the sliding overtone, and combined frequency and amplitude variation of the overtone.

In the embodiments described thus far, the overtone slides from an initial frequency to a higher or lower final frequency at which it remains until production of that note is terminated. The overtone need not slide continuously upward or continuously downward in frequency. Thus, the scale factors stored in the memory 51 could be such as to cause the overtone to slide both up and down in frequency in any desired pattern. Alternatively, the storage scale factors may cause a continuous rise in frequency of the sliding overtone when accessed in ascending address order, and when subsequently accessed in decreasing address order cause the overtone to slide in the reverse frequency direction. This could be accomplished by causing the counter 54 to decrement after it has incremented to its maximum value.

In the embodiment of FIG. 7, an arrangement is shown which can be used to produce a continuously sliding overtone which alternatively slides up and then down in frequency. This takes place when a switch 91 is closed to connect the "1" output of a flip-flop 92 to the up/down control input of the counter 54. As the counter initially increments to its maximum value, consecutive scale factors are accessed from the memory 51 to cause the overtone to slide upward in frequency. When the counter 54 reaches its maximum count, a carry (C) output is provided which sets the flip-flop 92 to the "1" state, thereby causing the counter 54 to switch to the "down" mode. As the counter 54 decrements, the same scale factors are accessed from the memory 51 but in reverse order, thereby causing the overtone to slide downward in frequency. When the counter 54 reaches zero, the flip-flop 92 is reset to return the counter to the "up" or increment mode. The process continues in this manner to produce an overtone that alternately slides up and down in frequency.

Amplitude modulation of the sliding overtone can be achieved by modifying the value of the harmonic coefficient $C_n=C_{n_s}$ which establishes the amplitude of that overtone.

To this end, a set of overtone amplitude scale factors are stored in a memory 95 which is accessed by a memory address control 96. During production of the sliding overtone, when $(n=n_s)$, the harmonic coefficient $C_{n_s}$ from the memory 15 is supplied to a multiplier 97 wherein it is scaled or multiplied by the amplitude scale factor currently accessed from the memory 95. This scaled harmonic coefficient is supplied via an enabled gate 98 and the coefficient scaler 63 to the harmonic amplitude multiplier 33. The scaled harmonic coefficient thus establishes the relative amplitude contribution of the sliding overtone, which thus will be time variant depending on the value of the scale factors in the memory 95, and the rate at which different such factors are accessed. For the other, non-sliding Fourier components, the unmodified harmonic coefficients $C_n$ from the memory 15 are supplied to the coefficient scaler 63 via a gate 99 that is enabled when $n \neq n_s$. Thus, the relative amplitudes of these components are not affected by the amplitude modulation of the sliding overtone.

The rate at which the sliding overtone is amplitude modulated may correspond to the rate at which the frequency of that overtone is modified. This can be achieved by setting a switch 100 to the position 100*a* shown in FIG. 7. The memory address control 96 then receives the contents of the counter 54, and thus will access consecutive amplitude scale factors from the memory 95 in unison with successive frequency scale factor accessing from the memory 51. Alternatively, the amplitude modulation may be a rate different from that at which the overtone slides in frequency. To this end, the switch 100 is set to the position 100*b*, so that accessing of consecutive amplitude scale factors is under control of a separate clock 101 and counter 102. The amplitude modulation rate may be set by a control 103 associated with the clock 101. As before, the clock 101 may comprise a voltage controlled oscillator, and the control 103 may be a potentiometer that supplies an adjustable voltage to the VCO 101. The memory 95 and the address control 96 may be implemented using a conventional integrated circuit read only memory such as those listed above as usable to implement the frequency scale factor memory 51 and address control 52.

Intending to claim all novel, useful and unobvious features shown or described, the inventor makes the following claims:

1. In a musical instrument of the type having a tone generator wherein in the amplitudes of a waveshape are computed for successive waveshape sample points at certain regular time intervals from stored harmonic coefficient values, said tone generator having calculator means for individually calculating, for reach computed amplitude, a set of W constituent Fourier components of said waveshape, said calculator means including a multiplier for multiplying a trigonometric function of the waveshape sample point by a harmonic coefficient value which establishes the relative amplitude of the Fourier component being calculated, order signal providing means for providing a signal indicating the order *n* of the Fourier component currently being calculated, where $n=1, 2, \ldots, W$ and where *n*R corresponds to the nominal frequency of the $n^{th}$ order Fourier component, and where R is a frequency number which establishes the fundamental frequency of the musical note being produced, accumulator means, connected to said calculator means, for combining said calculated components to obtain the waveshape amplitude at each sample point, and converter means for converting said computed waveshape amplitudes for successive sample points to musical sounds as said computations are carried out, the improvement for providing a sliding overtone effect, comprising:

first means, responsive to said Fourier component order indicating signal from said providing means, for providing a sliding overtone enable signal when a certain order Fourier component currently is being calculated, and second means, responsive to occurrence of said sliding overtone enable signal and connected to said calculator means, for modifying the argument of the trigonometric function for said certain order Fourier component as a function of time, thereby causing the effective frequency of said certain order Fourier component to vary so as to produce a sliding overtone effect.

2. A musical instrument according to claim 1 wherein said second means comprises:

overtone scale factor circuitry for providing a set of frequency scale factors that vary as a function of time, and a multiplier for multiplying the unmodified trigonometric function argument for said certain order Fourier component by the frequency scale factor currently provided by said circuitry, the resultant scaled argument being used in the calculation of said certain order Fourier component.

3. A musical instrument according to claim 2 wherein said overtone scale factor circuitry comprises:

a memory storing a set of overtone frequency scale factors, and memory address control circuitry for accessing successive frequency scale factors from said memory at successive time intervals, said accessed scale factors being provided to said multiplier.

4. A musical instrument according to claim 3 wherein said set of frequency scale factors are selected so that said certain order Fourier component is calculated successively at different frequencies which are harmonically related to the fundamental frequency of the produced musical note.

5. A musical instrument according to claim 3 wherein said set of frequency scale factors are selected so that said certain order Fourier component is calculated successively at different frequencies which are not harmonically related to the fundamental frequency of the produced musical note.

6. A musical instrument according to claim 3 wherein the rate at which successive frequency scale factors are accessed from said memory is controlled by a clock of adjustable clock rate, adjustment of said clock rate thereby establishing the rate at which the frequency of said certain order Fourier component varies, and hence establishing the "slide speed" of said sliding overtone effect.

7. A musical instrument according to claim 3 further comprising:

an overtone slide direction control for selecting the order in which said frequency scale factors are accessed from said memory, and thereby establishing whether said certain order Fourier component varies upward or downward in frequency.

8. A musical instrument according to claim 1 further comprising:

another like first means for providing a second sliding overtone enable signal when a different, order Fourier component currently is being calculated, and another second means, responsive to occurrence of said second sliding overtone enable signal, for modifying the argument of the trigonometric function of said different order Fourier component as a function of time, thereby causing the effective frequency of said different order Fourier component to vary so as to produce an effect in which the produced musical note has two sliding overtones.

9. A musical instrument according to claim 1 further comprising:

harmonic inhibit means for inhibiting inclusion among said components combined to obtain each sample point waveshape amplitude those Fourier components having a frequency below the effective frequency of said certain order Fourier component.

10. A musical instrument according to claim 1 further comprising:

harmonic inhibit means for inhibiting inclusion among said components combined to obtain each sample point waveshape amplitude those Fourier components having a frequency above the effective frequency of said certain order Fourier component.

11. A musical instrument according to claim 1 further comprising:

amplitude modulation means for modulating the relative amplitude of said certain order Fourier component as the effective frequency of said same Fourier component is being varied.

12. A musical instrument according to claim 1, said calculator means further including a note interval adder containing the value ($q$R) where $q$ is an integer that is incremented at each of said regular time intervals, said value ($q$R) establishing the sample point at which said waveshape amplitude currently is computed, said calculator means further having a harmonic interval adder to the contents of which there is added the value ($q$R) from said note interval adder each time that a Fourier component is calculated, the contents of said harmonic interval adder thereby representing the quantity ($nq$R) where $n$ is an integer that corresponds to the order of the Fourier component presently being calculated and where ($nq$R) is the unmodified trigonometric function argument for the Fourier component of order $n$, and wherein said first means modifies the value $nq\mathrm{R}=n_sq\mathrm{R}$ for said Fourier component of certain order $n=n_s$, said modified value $n_sq$R being supplied to said first means from said harmonic interval adder.

13. A musical instrument according to claim 12 further comprising:

circuitry for providing a set of frequency scale factors $s(t)$ that vary as a function of time, and a multiplier for multiplying the unmodified argument $n_sq$R by the scale factor $s(t)$ currently provided by said circuitry, the product $s(t)n_sq\mathrm{R}$ being used by said instrument as the argument for the trigonometric function from which said certain order Fourier component is calculated.

14. In an electronic musical instrument of the type having computor means for computing the amplitudes at successive sample points of a musical waveshape by individually calculating the waveshape discrete Fourier components, accumulator means for combining said components to obtain each amplitude, and converter means for converting said amplitudes to musical notes as said computations are carried out, the improvement wherein at least one of said Fourier components varies in frequency so that said musical waveshape includes a sliding overtone, said computor means comprising:

a memory storing frequency numbers R associated with each note and establishing the separation between successive amplitude sample points, note selection means for accessing from said memory the frequency number R associated with a selected note, means, utilizing the accessed frequency number R, for establishing the respective frequency ($n$R) at which each Fourier component is evaluated, where $n$ is the Fourier component order, Fourier component evaluation circuitry, utilizing said values ($n$R) to calculate the waveshape amplitude contributions of each Fourier component, all of said components being calculated and combined to obtain said amplitudes, said evaluation circuitry providing a signal indicating which Fourier component $n$ currently is being calculated, said instrument further comprising:

a comparator for detecting coincidence between the value $n$ provided by said evaluation circuitry and a fixed value $n_s$ designating said at least one Fourier component that is to vary in frequency, and frequency varying circuitry, operative upon detection by said comparator of coincidence between values of $n$ and $n_s$, for modifying said value ($n$R)=($n_s$R) as a function of time, and for providing the modified value to said Fourier component evaluation circuitry for use thereby instead of the unmodified value, so that the corresponding Fourier component will vary in frequency to provide said sliding overtone.

15. A musical instrument according to claim 14 wherein said frequency varying circuitry modifies said value $(nR)=(n_sR)$ monotonically in time so as to produce an overtone that slides in one frequency direction between preestablished frequency limits.

16. A musical instrument according to claim 14 wherein said frequency varying circuitry includes:

scaler means for scaling said value $(nR)=(n_sR)$ by a scale factor which changes in time.

17. A musical instrument according to claim 16 wherein said frequency varying circuitry further comprises:

a slide speed control for adjusting the rate at which said scale factor changes in time, said control thereby adjusting the speed at which said overtone slides.

18. A musical instrument according to claim 14 wherein Fourier components having a preestablished frequency relationship to the frequency of said at least one Fourier component are deleted from the waveshape amplitude computation, comprising:

frequency comparator means for comparing the current frequency of said at least one Fourier component with the frequency of each other Fourier component, and inhibit means, cooperating with said frequency comparator means and with said Fourier component evaluation circuitry, for inhibiting calculation of each Fourier component having a preestablished frequency relationship to said current frequency.

19. A musical instrument according to claim 18 wherein said frequency comparator means comprises:

a storage device connected to said frequency varying circuitry, that stores a value directly proportional to the most recent modified value of $(nR)=(n_sR)$, a second comparator connected to compare said most recent modified value of $(nR)=(n_sR)$ stored in said storage device with a value similarly directly proportional to the value $n$R of the Fourier component currently being evaluated, said second comparator providing an output signal when said compared values bear said certain preestablished relationship to each other, said inhibit means being responsive to occurrence of said output signal.

20. A musical instrument according to claim 19 wherein each waveshape sample point is established by the value $q$R, where $q$ is an integer that is incremented at fixed time intervals $t_x$ at which successive waveshape amplitudes are computed, and wherein said storage device stores the modified value ($n_sq$R) and wherein said second comparator compares this stored value with the value $nq$R associated with each other Fourier component.

* * * * *